US009157307B2

(12) United States Patent
Schultz

(10) Patent No.: US 9,157,307 B2
(45) Date of Patent: Oct. 13, 2015

(54) DOWNHOLE GAS SEPARATOR

(71) Applicant: Thru Tubing Solutions, Inc., Oklahoma City, OK (US)

(72) Inventor: Roger Schultz, Newcastle, OK (US)

(73) Assignee: Thru Tubing Solutions, Inc., Oklahoma City, OK (US)

( * ) Notice: Subject to any disclaimer, the term of this patent is extended or adjusted under 35 U.S.C. 154(b) by 0 days.

(21) Appl. No.: 14/469,694

(22) Filed: Aug. 27, 2014

(65) Prior Publication Data

US 2015/0068741 A1 Mar. 12, 2015

Related U.S. Application Data

(60) Provisional application No. 61/877,025, filed on Sep. 12, 2013.

(51) Int. Cl.

| | |
|---|---|
| ***E21B 47/00*** | (2012.01) |
| ***E21B 21/00*** | (2006.01) |
| ***E21B 43/34*** | (2006.01) |
| *E21B 49/00* | (2006.01) |
| *E21B 21/06* | (2006.01) |

(52) U.S. Cl.

CPC ..... *E21B 43/34* (2013.01); *E21B 21/002* (2013.01); *E21B 21/067* (2013.01); *E21B 47/00* (2013.01); *E21B 49/005* (2013.01)

(58) Field of Classification Search

CPC ..... E21B 21/067; E21B 47/00; E21B 49/005; E21B 49/08; E21B 2021/006; E21B 21/00

See application file for complete search history.

(56) References Cited

U.S. PATENT DOCUMENTS

| | | | | |
|---|---|---|---|---|
| 2,364,799 | A | 3/1941 | Laughlin et al. | |
| 3,533,506 | A | 10/1970 | Carr | |
| 4,428,839 | A | 1/1984 | Davies et al. | |
| 4,475,603 | A | 10/1984 | Hayatdavoudi | |
| 4,688,650 | A | 8/1987 | Hayatdavoudi et al. | |
| 5,028,318 | A | 7/1991 | Aslin | |
| 6,053,967 | A | 4/2000 | Heilmann et al. | |
| 6,113,675 | A | 9/2000 | Branstetter | |
| 6,355,178 | B1 | 3/2002 | Couture et al. | |
| 6,517,732 | B1 | 2/2003 | Brockoff et al. | |
| RE39,292 | E * | 9/2006 | Latos et al. | 166/265 |
| 7,846,343 | B2 | 12/2010 | Schook | |
| 8,353,411 | B2 | 1/2013 | Schook | |
| 2002/0178924 | A1 | 12/2002 | Brown et al. | |
| 2006/0157282 | A1 * | 7/2006 | Tilton et al. | 175/65 |
| 2007/0062374 | A1 * | 3/2007 | Kolle | 96/217 |
| 2009/0152204 | A1 | 6/2009 | Chantrel et al. | |
| 2010/0319926 | A1 * | 12/2010 | Reid | 166/372 |
| 2012/0000643 | A1 | 1/2012 | Bruun et al. | |

* cited by examiner

*Primary Examiner* — Zakiya W Bates

(74) *Attorney, Agent, or Firm* — Hall Estill Law Firm

(57) ABSTRACT

A downhole tool for separating fluids into a liquid and a gas component are provided herein. The downhole tool includes an inlet for receiving a multiphase fluid, the multiphase fluid comprising a gas component and a liquid component. The tool also includes a hydrocyclone portion where the flow of the multiphase fluid is vortical and the liquid component migrates to an inner surface of the hydrocyclone portion and the gas component is forced to a central area of the hydrocyclone portion and exits the downhole tool via a gas outlet. The tool further includes a liquid outlet permitting the liquid component to exit the downhole tool.

17 Claims, 2 Drawing Sheets

DOWNHOLE GAS SEPARATOR

STATEMENT REGARDING FEDERALLY SPONSORED RESEARCH OR DEVELOPMENT

Not applicable.

CROSS-REFERENCE TO RELATED APPLICATIONS

The present application is a conversion of U.S. Provisional Application having U.S. Ser. No. 61/877,025, filed Sep. 12, 2013, which claims the benefit under 35 U.S.C. 119(e). The disclosure of which is hereby expressly incorporated herein by reference.

BACKGROUND OF THE DISCLOSURE

1. Field of the Invention

The present disclosure relates to a downhole tool that separates a multiphase fluid into its gas component and liquid component.

2. Description of the Related Art

Multiphase fluids are common in oil and gas operations. The gas component of a multiphase fluid can sometimes be problematic for some tools used in oil and gas operations.

Accordingly, there is a need for a downhole tool that can be used to separate the gas component of a multiphase fluid from the liquid component and provide the liquid component to other tools used in the oil and gas operations.

SUMMARY OF THE DISCLOSURE

The disclosure is directed toward a downhole tool for separating fluids into a liquid and a gas component. The downhole tool includes an inlet for receiving a multiphase fluid, the multiphase fluid comprising a gas component and a liquid component. The tool also includes a hydrocyclone portion where the flow of the multiphase fluid is vortical and the liquid component migrates to an inner surface of the hydrocyclone portion and the gas component is forced to a central area of the hydrocyclone portion and exits the downhole tool via a gas outlet. The tool further includes a liquid outlet permitting the liquid component to exit the downhole tool.

The disclosure is also directed toward a method of using the downhole separator tool. A multiphase fluid is provided to a downhole tool included in a bottom hole assembly (BHA) to separate the multiphase fluid into a gas component and a liquid component. The gas component is expelled from the downhole tool and the liquid component is forced from the downhole tool into other tools disposed in the BHA below the downhole tool.

DETAILED DESCRIPTION OF THE DISCLOSURE

The present disclosure relates to a downhole tool 10 that separates multiphase fluids flowing through a bottom hole assembly (BHA). Primarily, the downhole tool 10 separates the fluids flowing into a primarily gas component and a primarily liquid component. The gas component is expelled from the separator tool and not permitted to pass into other components of the BHA below the downhole tool 10. The liquid component is permitted to flow out of the downhole tool 10 into the other components of the BHA disposed below the downhole tool 10.

Figure 1:
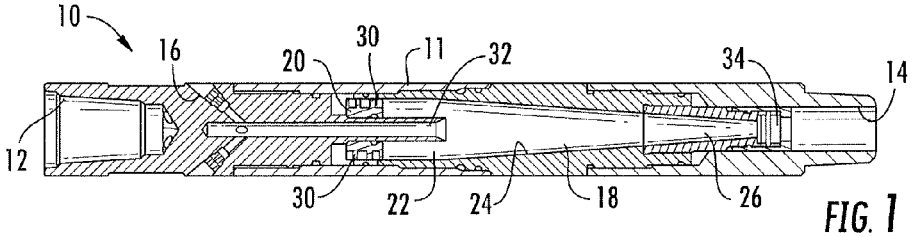
FIG. 1 is a side elevation view of a cross-section downhole tool constructed in accordance with the present disclosure.
Figure 2:
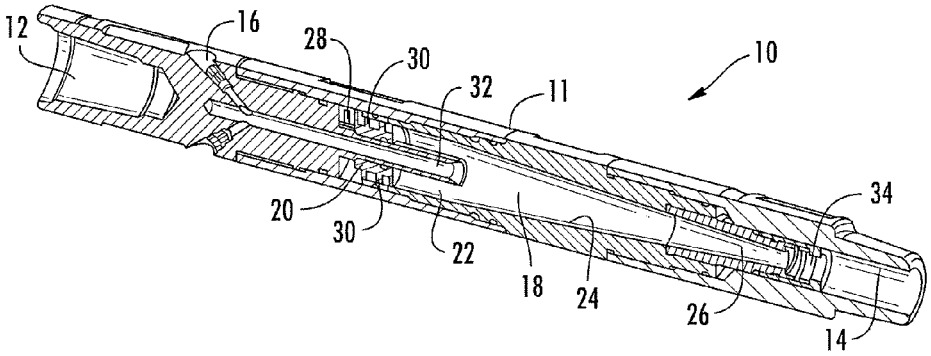
FIG. 2 is a perspective view of a cross-section of the downhole tool shown in FIG. 1 and constructed in accordance with the present disclosure.
Figure 3:
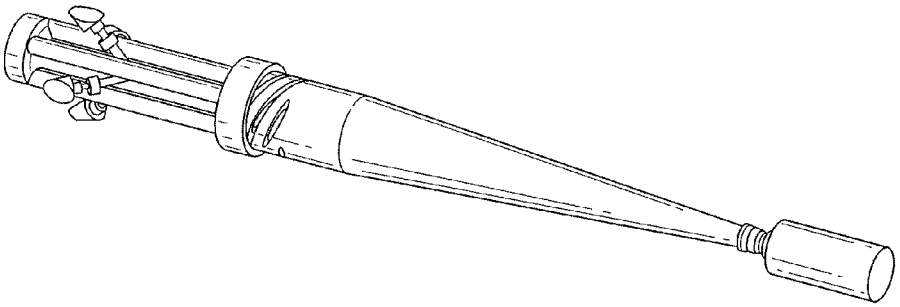
FIG. 3 is a fluid model of the downhole tool constructed in accordance with the present disclosure.

As shown in FIGS. 1 and 2, the downhole tool 10 includes a housing 11, an inlet 12 for receiving a multiphase flow of fluid, a liquid outlet 14 for expelling the liquid component from the tool, at least one gas outlet 16 for expelling the gas component from the tool 10, and a hydrocyclone portion 18 (or chamber) disposed between the inlet 12 and the liquid outlet 14. The hydrocyclone portion 18 is also in fluid communication with the inlet 12 and the liquid outlet 14. FIG. 3 provides a fluid model of the downhole tool 10. The fluid model shows the volume of the downhole tool 10 that can be occupied by fluid.

In another embodiment, the downhole tool 10 includes a vortical flow generation device 20 disposed between the inlet 12 and the hydrocyclone portion 18. Multiphase flow received at the inlet 12 is passed to the vortical flow generation device 20 which causes the multiphase fluid to enter a top portion 22 of the hydrocyclone portion 18 tangentially to an inner surface 24 of the hydrocyclone portion 18. This tangential flow of the multiphase fluid into the hydrocyclone portion 18 forces the fluid into a vortical flow in the hydrocyclone portion 18. The vortical flow causes centrifugal acceleration of the multiphase fluid inside the hydrocyclone portion 18. Velocity of the multiphase fluid increases dramatically as the multiphase fluid travels down to a bottom portion 26 of the hydrocyclone portion 18, which reduces in diameter as the multiphase fluid travels from the top portion 22 of the hydrocyclone portion 18 toward the bottom portion 26 of the hydrocyclone portion 18. As the velocity of the multiphase fluid increases, the heavier fluids (primarily liquid component) in the multiphase fluid are forced towards the inner surface 24 of the hydrocyclone portion 18, and the lighter fluids (gas component) are forced toward a central area of the hydrocyclone portion 18. The gas component is then forced from the center of the hydrocyclone portion out of the at least one gas outlet 16.

The hydrocyclone portion 18 is conical shaped and has a predetermined length. The top portion 22 of the hydrocyclone portion 18 has a diameter that is larger than the bottom portion 26. The length of the hydrocyclone portion 18 and the diameters of the top portion 22 and the bottom portion 26 of the hydrocyclone portion 18 can be sized such that desired vortex properties of the multiphase fluid entering the hydrocyclone portion 18 can be achieved.

In one embodiment of the present disclosure, the downhole tool 10 includes at least one throughway 28 in fluid communication with the inlet 12 and the vortical flow generation device 20 to direct the flow of multiphase fluid to the vortical flow generation device 20.

The vortical flow generation device 20 can be any device capable of causing the multiphase fluid entering the hydrocyclone portion 18 to enter tangentially to the inner surface 24 of the hydrocyclone portion 18 and/or generate a vertical flow of the multiphase fluid in the hydrocyclone portion 18. In one embodiment, the vortical flow generation device 20 includes at least one downwardly angled lip 30 to cause the flow to be vortical as it enters the hydrocyclone portion 18. In another embodiment, the vortical flow generation device 20 includes a plurality of the downwardly angled lips 30 to cause the flow of fluid to be vortical as it enters the hydrocyclone portion 18. In another embodiment, the downwardly angled lip 30 can have a helical shape.

In a further embodiment of the disclosure, the downhole tool 10 includes a gas collection housing 32 that is disposed at least partially inside the hydrocyclone portion 18 and is in fluid communication with the at least one gas outlet 16. The gas collection housing 32 collects the gas component from the central area of the hydrocyclone portion 18 and directs the gas toward the at least one gas outlet 16. In another embodiment, the downhole tool 10 includes a plurality of gas outlets 16 in fluid communication with the gas collection housing 32. The liquid component is then forced out of the liquid outlet 14 of the downhole tool 10.

In yet another embodiment, the downhole tool 10 includes a liquid exit nozzle 34 disposed between the hydrocyclone portion 18 and the liquid outlet 14 to provide some additional resistance to the liquid component exiting the downhole tool 10 via the liquid outlet 14. The resistance allows for better expulsion of the gas component from the hydrocyclone portion 18. Additionally, the gas outlets 16 can be equipped with gas nozzles (not shown) to assist in expelling the gas from the downhole tool 10. These gas nozzles can also be used to adjust the flowrate of the fluid exiting the gas outlets 16.

The downhole tool 10 described herein can remove any amount of the gas component from the multiphase fluid desirable. In one embodiment, the liquid component exiting the downhole tool 10 has a gas component less than about 50 weight or volume percent. In another embodiment, the liquid component exiting the downhole tool 10 has a gas component less than about 20 weight or volume percent. In a further embodiment, the liquid component exiting the downhole tool 10 has a gas component less than about 1 weight or volume percent.

The present disclosure is also directed toward a method of separating a gas component and a liquid component out of a multiphase fluid. A multiphase fluid flows into the downhole tool 10 described herein and separated into the gas and liquid component. The liquid component is expelled through the liquid outlet 14 of the downhole tool 10 and the gas component is forced upward (i.e., upstream direction in the downhole tool 10) and out of the gas outlet 16 of the downhole tool 10.

Figure 4:
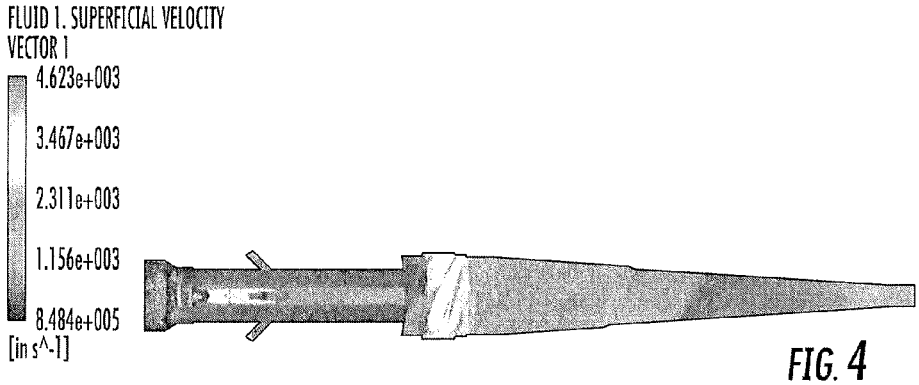
FIG. 4 is a flow velocity model of the downhole tool constructed in accordance with the present disclosure.
Figure 5:
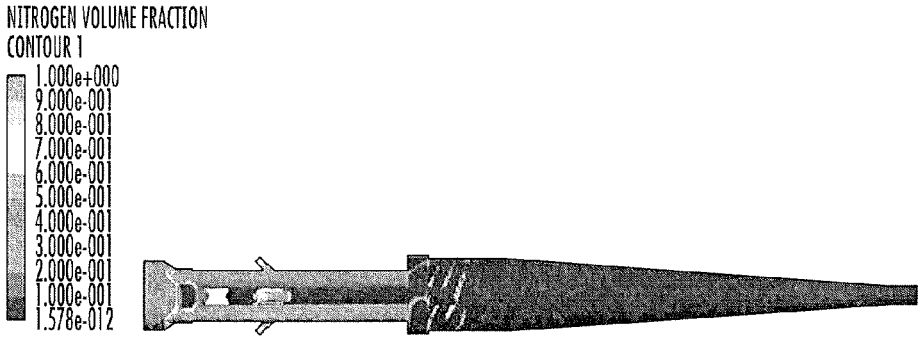
FIG. 5 is a gas volume fraction model of the downhole tool constructed in accordance with the present disclosure.
Figure 6:
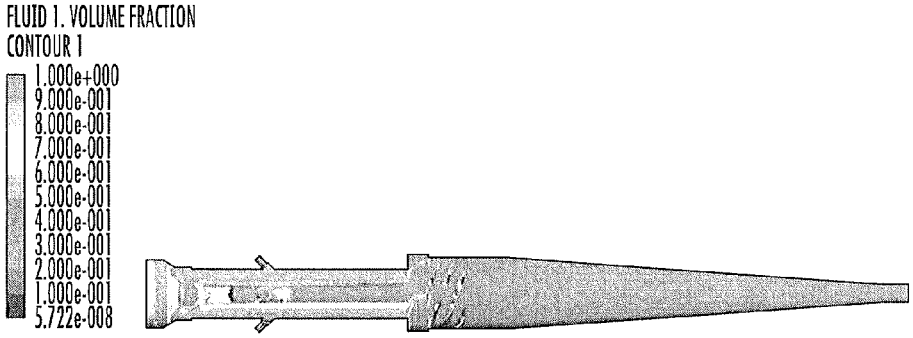
FIG. 6 is a liquid volume fraction model of the downhole tool constructed in accordance with the present disclosure.

FIGS. 4-6 show, via fluid models, the separation of the multiphase fluid after it enters the downhole tool 10. FIG. 4 shows the velocity profile of the multiphase fluid exiting the vortical flow generation device 20 and beginning the vortical flow in the hydrocyclone portion 18 of the downhole tool 10. FIG. 5 shows the gas fraction of the fluid in the downhole tool 10. A high gas fraction can be seen in the central area of the hydrocyclone portion 18 and at the gas outlets 16. FIG. 6 shows the liquid fraction of the fluid in the downhole tool 10. The high liquid fraction can be seen in red which means that the liquid component is pushed against the inner surface 24 of the hydrocyclone portion 18 due to the vortical flow of the fluid in the hydrocyclone portion 18.

From the above description, it is clear that the present disclosure is well adapted to carry out the objectives and to attain the advantages mentioned herein as well as those inherent in the disclosure. While presently preferred embodiments have been described herein, it will be understood that numerous changes may be made which will readily suggest themselves to those skilled in the art and which are accomplished within the spirit of the disclosure and claims.

What is claimed is:

1. A downhole tool, the tool comprising:

an inlet for receiving a multiphase fluid, the multiphase fluid comprising a gas component and a liquid component;

a hydrocyclone portion where the flow of the multiphase fluid is vortical and the liquid component migrates to an inner surface of the hydrocyclone portion and the gas component is forced to a central area of the hydrocyclone portion and exits the downhole tool via a gas outlet;

a vortical flow generation device disposed between the inlet and the hydrocyclone portion to create vortical flow of the multiphase fluid in the hydrocyclone portion; and a liquid outlet permitting the liquid component to exit the downhole tool.

2. The tool of claim 1 wherein the vortical flow generation device includes at least one downwardly angled lip.

3. The tool of claim 2 wherein the downwardly angled lip has a helical shape.

4. The tool of claim 1 wherein the downhole tool further comprises a nozzle disposed between the hydrocyclone portion and the liquid outlet to adjust the flowrate of fluid exiting the liquid outlet.

5. The tool of claim 1 wherein the downhole tool further includes a gas collection housing in fluid communication with the at least one gas outlet and disposed in at least an upper portion of a central area in the hydrocyclone portion to capture the gas component forced into the central area of the hydrocyclone portion due to the vortical flow of the multiphase fluid in the hydrocyclone portion.

6. The tool of claim 1 wherein the liquid component exiting the downhole tool has a gas component less than about 50 weight or volume percent.

7. The tool of claim 1 wherein the liquid component exiting the downhole tool has a gas component less than about 20 weight or volume percent.

8. The tool of claim 1 wherein the liquid component exiting the downhole tool has a gas component less than about 1 weight or volume percent.

9. The tool of claim 1 wherein the downhole tool further comprises at least one throughway disposed between the inlet and the vortical flow generation device to direct the multiphase fluid to the specific portions of the vortical flow generation device.

10. A method, the method comprising:

providing a multiphase fluid to a downhole tool included in a bottom hole assembly (BHA) to separate the multiphase fluid into a gas component and a liquid component the downhole tool comprising:

an inlet for receiving a multiphase fluid, the multiphase fluid comprising a gas component and a liquid component;

a hydrocyclone portion where the flow of the multiphase fluid is vortical and the liquid component migrates to an inner surface of the hydrocyclone portion and the gas component is forced to a central area of the hydrocyclone portion and exits the downhole tool via a gas outlet;

a vortical flow generation device disposed between the inlet and the hydrocyclone portion to create vortical flow of the multiphase fluid in the hydrocyclone portion; and a liquid outlet permitting the liquid component to exit the downhole tool;

expelling the gas component from the downhole tool; and forcing the liquid component from the downhole tool into other tools disposed in the BHA below the downhole tool, the liquid component forced from the downhole tool on an opposite end of the downhole tool from where the gas component is expelled from.

11. The method of claim 10 wherein the vortical flow generation device includes at least one downwardly angled lip.

12. The method of claim 11 wherein the downwardly angled lip has a helical shape.

13. The method of claim 10 wherein the downhole tool further comprises a nozzle disposed between the hydrocyclone portion and the liquid outlet to adjust the flowrate of fluid exiting the liquid outlet.

14. The method of claim 10 wherein the downhole tool further includes a gas collection housing in fluid communication with the at least one gas outlet and disposed in at least an upper portion of a central area in the hydrocyclone portion to capture the gas component forced into the central area of the hydrocyclone portion due to the vortical flow of the multiphase fluid in the hydrocyclone portion.

15. The method of claim 10 wherein the liquid component exiting the downhole tool has a gas component less than about 50 weight or volume percent.

16. The method of claim 10 wherein the liquid component exiting the downhole tool has a gas component less than about 20 weight or volume percent.

17. The method of claim 10 wherein the liquid component exiting the downhole tool has a gas component less than about 1 weight or volume percent.

* * * * *